United States Patent [19]

Luthi

[11] 4,099,268

[45] Jul. 4, 1978

[54] MIXING DEVICE

[75] Inventor: Oscar Luthi, Nashua, N.H.

[73] Assignee: Ingersoll-Rand Company, Woodcliff Lake, N.J.

[21] Appl. No.: 761,631

[22] Filed: Jan. 24, 1977

[51] Int. Cl.[2] ..... B01F 5/00

[52] U.S. Cl. ..... 366/338

[58] Field of Search ..... 259/4 AB, 4 AC, 4 R, 259/4 A; 138/37, 38, 42, 43; 48/180 R, 180 M, 180 B; 239/402, 432, 466, 487

[56] References Cited

U.S. PATENT DOCUMENTS

| | | | |
|---|---|---|---|
| 1,632,888 | 6/1927 | Davis et al. | 138/38 X |
| 2,999,672 | 9/1961 | Harshman | 259/4 R |
| 3,286,992 | 11/1966 | Armeniades et al. | 259/4 AB |
| 3,351,091 | 11/1967 | Chambert | 138/39 X |
| 3,381,713 | 5/1968 | Jacobsen | 138/42 X |
| 3,529,631 | 9/1970 | Riollet | 138/39 |
| 3,671,208 | 6/1972 | Meosker | 48/180 M X |
| 3,704,006 | 11/1972 | Grout et al. | 259/4 AB |

*Primary Examiner*—Philip R. Coe
*Attorney, Agent, or Firm*—Frank S. Troidl

[57] ABSTRACT

This device mixes solid-liquids with a fluid while conveying them. A plurality of fixed elements extend in a series longitudinally within a hollow conduit. Each element divides the conduit into two separate channels. The elements are constructed so that material flowing through one of the channels moves at a different rate of speed when compared to particles flowing through the other channel.

3 Claims, 3 Drawing Figures

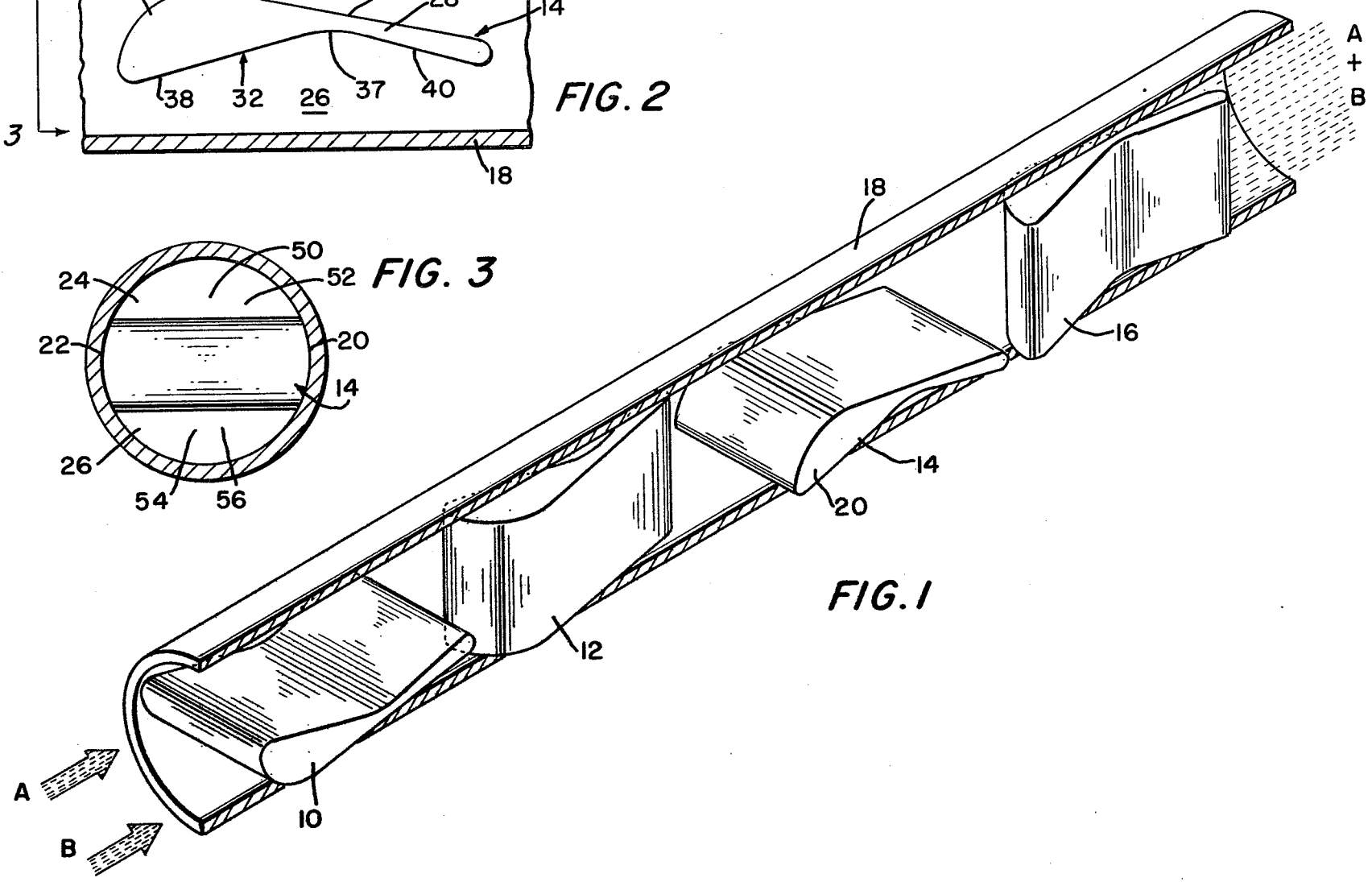
FIG. 1
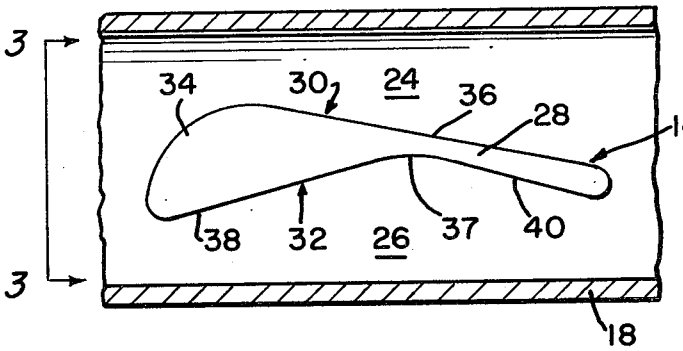
FIG. 2
FIG. 3

MIXING DEVICE

This invention relates to mixing devices. More particularly this invention is a new mixer with no moving elements.

Historically, various apparatus have been used for mixing solid-liquid mixtures with liquid or liquid-gas suspensions. For example, chlorine-water suspensions may be mixed with a pulp slurry or chlorine-dioxide mixed with a pulp slurry of pulp in water.

Mechanical mixers have been used. However, high corrosion coupled with vigorous mechanical action have made these mechanical mixers a maintenance problem in the mills. Also, high power consumption of mechanical mixers becomes more and more objectionable.

There are currently marketed mixers with no moving elements. Examples of such mixers are shown in U.S. Pat. No. 3,286,992 granted Nov. 22, 1966 to C. D. Armeniades et al and entitled "MIXING DEVICE"; U.S. Pat. No. 3,664,638 granted May 23, 1972 to K. M. Grout et al and entitled "MIXING DEVICE"; and U.S. Pat. No. 3,704,006 granted Nov. 28, 1972 to Grout et al and entitled "DISPERSION PRODUCING METHOD". These mixers consist of a series of fixed elements enclosed within a tubular housing. The fixed elements are generally helical or some other shape to cause a forced rotary motion of the material flowing past the elements. This forced rotary or circumferential movement of the material causes sudden velocity reversals or turbulence and creates large flow resistence. This large flow resistence results in high power consumption which cannot be recovered.

The mixer according to the present invention includes elements which are constructed for maximum mixing with minimum flow resistence. Hydraulic mixing is accomplished primarily by fluid shear with a minimum amount of turbulence. The energy required to induce fluid shear can generally be recovered.

Briefly described, this device for mixing a material comprising a solid-liquid with a fluid while conveying the material is a hollow conduit with a plurality of fixed elements extending in a series longitudinally within the conduit. Each element is constructed to divide the conduit into two separate channels. The cross-sectional areas of the two channels are unequal at substantially all transverse planes through the elements. The elements are shaped so that the material flowing through one channel is speeded-up and the material flowing through the other channel is slowed down.

Each of the longitudinal series of elements are of the same shape; however, each element may be circumferentially spaced from adjacent elements by a predetermined circumferential angle. The elements are not helical; there is no forced rotary movement in the material as the material flows past the elements. Therefore, the mixing is caused primarily by a shearing action of the fluids; the only turbulent mixing being when the material hits the upstream end of each element. Thus, the power consumption is minimized and yet appropriate and proper mixing occurs.

The invention, as well as its many advantages, may be further understood by reference to the following detailed description and drawings in which:

FIG. 1 is a perspective view of the mixer with the tube shown in section and illustrating the positions of the series of elements for mixing the material;

FIG. 2 is a side view of one of the elements with the tube shown in section; and FIG. 3 is a view taken along lines 3—3 of FIG. 2 and in the direction of the arrows.

In the various figures, like parts are referred to by like numbers.

As shown in FIG. 1, a series of longitudinal elements such as elements 10, 12, 14 and 16 are mounted within a tubular conduit 18. In the preferred embodiment shown, the elements are longitudinally separated from one another and each element is located at a circumferentially spaced angle from its adjacent elements. The upstream end of element 12 is circumferentially spaced 90° with respect to the downstream end of element 10, the upstream end of element 14 is circumferentially spaced 90° with respect to the downstream end of element 12, and the upstream end of element 16 is circumferentially spaced 90° with respect to the downstream end of element 14.

Various materials may be mixed by this mixer. For example, chlorine-water suspension may be fed to the tube 18 as shown by the arrows A and a separate material such as a pulp slurry may be fed to the tubular member 18 as indicated by the arrow B.

The specific structure of element 14 will be described. However, all of the elements 10, 12, 14 and 16 have the same shape; thus the description of element 14 will also serve to describe the other elements contained within the tubular member 18.

Referring to FIG. 3, element 14 has two diametrically opposite sides 20 and 22 in contact with the inside of the tube 18. Thus, as the materials A and B flow past the element 14, the materials divide into two channels. The element is shaped so that the two separate channels are unequal in cross-sectional area at substantially all transverse planes through the element. Thus, the cross-sectional areas through substantially all transverse planes through the element 14 provides a different cross-sectional area along channel 24 than along channel 26. Only at point 28 on the element 14 are the two channels 24 and 26 substantially the same in cross-sectional area.

Sides 30 and 32 of element 14 are spaced from the inside of the tube 18. Side 30 is constructed to speed-up the material in channel 24; side 32 is constructed to slow down the material in channel 26. To speed-up the material in channel 24 the upstream end of element 14 includes a curved surface 34 of a predetermined radius of curvature extending from the upstream end of the element 14 toward the downstream end of the element. Curved surface 34 is integral with flat surface 36 extending from the curved surface 34 to the downstream end of the element 14.

Side 32 of element 14 includes a first flat surface 38 extending inwardly from the upstream end of the element to approximately the axis of the tube. A curved portion 37 connects surface 38 to a second flat surface 40 extending outwardly from approximately the axis of the tube to the downstream end of the element 14.

All of the mixing is done by a shearing action except at the areas in the tube 18 where the material hits the upstream end of an element. Thus, the turbulent action is minimized, requiring less power.

In operation, a material such as a chlorine-water suspension may be fed to the tube at point A and a pulp slurry may be fed to the tube 18 at point B. As the materials flow past the element 10 the materials are divided into two separate channels with one channel speeding-up the materials and the other channel slowing down the materials. The materials are turbulently mixed in the space between elements 10 and 12 because element 12 is circumferentially spaced 90° from element 10. The stream is again divided into two channels with the material in one channel being speeded-up and the material in the other channel being slowed down. As the partially mixed material leaves element 12 there is again a small amount of turbulence because of the 90° spacing of element 14. The same action on the material as explained with regard to elements 10 and 12 occurs as the material flows past elements 14 and 16. Even within each channel a particular portion of the material is speeded-up or slowed down, as the case may be, different amounts. For example, looking at FIG. 3, it can be seen that a portion of the material at point 50 is speeded-up less than a particular portion of the material at point 52. Also, it can be seen that a particular portion of material at point 54 in channel 26 is slowed down more than a particular portion at point 56.

By the time the mixed material leaves the tube 18 at the downstream side, the materials A and B are thoroughly mixed for feeding to the next stage.

I claim:

1. A device for mixing material comprising a solid-liquid with a fluid while conveying them comprising: a hollow conduit; a plurality of fixed elements extending in a series longitudinally within said conduit; each element being constructed to cause mixing by a shearing action and to divide said conduit into two separate channels, the cross-sectional areas of said two channels being unequal at substantially all transverse planes through the elements, each element having at least four sides, with two diametrically opposite sides of each element in full contact with the inside of the tube, and the two other sides of each element spaced from the inside of the tube, one of the two sides spaced from the inside of the tube being constructed to speed-up the material and including a curved surface of predetermined radius of curvature extending from the upstream end of the element toward the downstream end of the element, said curved surface being integral with a flat surface extending to the downstream end of the element; and the other side is constructed to slow-down the material.

2. A device in accordance with claim 1 wherein the side constructed to slow-down the material comprises: a first flat surface extending inwardly from said curved surface toward the axis of the tube, and a second flat surface extending outwardly from approximately the axis of the tube to the downstream end of the element.

3. A device in accordance with claim 2 wherein: the two diametrically opposite sides of each element in full contact with the inside of the tube are circumferentially spaced from the two diametrically opposite sides of adjacent elements by a predetermined circumferential angle.

* * * * *